United States Patent [19]

Simpson

[11] Patent Number: 4,768,971

[45] Date of Patent: Sep. 6, 1988

[54] CONNECTOR ARRANGEMENT

[75] Inventor: Scott S. Simpson, Woodstock, Conn.

[73] Assignee: Rogers Corporation, Rogers, Conn.

[21] Appl. No.: 69,251

[22] Filed: Jul. 2, 1987

[51] Int. Cl.[4] ..... H01R 9/09

[52] U.S. Cl. ..... 439/329; 439/67; 439/493

[58] Field of Search ..... 439/67, 77, 259, 260, 439/329, 492, 493, 497

[56] References Cited

U.S. PATENT DOCUMENTS

| | | | |
|---|---|---|---|
| Re. 31,114 | 12/1982 | Berg | 339/17 CF |
| 1,610,555 | 12/1926 | Kindl | 200/277 |
| 3,173,737 | 3/1965 | Kinkaid et al. | 339/176 MF |
| 3,356,983 | 12/1967 | Johnson, Jr. | 339/14 |
| 3,582,865 | 6/1971 | Franck et al. | 339/17 |
| 3,587,031 | 6/1971 | Flavin | 339/75 MP |
| 3,597,660 | 8/1971 | Jensen | 339/17 |
| 3,701,964 | 10/1972 | Cronin | 339/17 F |
| 3,745,509 | 7/1973 | Woodward et al. | 339/14 R |

(List continued on next page.)

OTHER PUBLICATIONS

Abbatecola et al., *IBM Technical Disclosure Bulletin* (Mar., 1968), vol. 10, No. 10, p. 1462.

Connecting Devices Bulletin, Oct., 1976 (3 pages), Hughes Aircraft Co.

RSS TM Rogers Solderless System for Interconnections, Copyright 1979, Rogers Corporation.

Burke, "Flex Circuit Zero Insertion Force Connector", *IBM Technical Disclosure Bulletin,* vol. 26, No. 12, (May, 1984) p. 6657.

Mersereau, Rogers Solderless System, Proceedings of the Fourth International Electronics Packaging Conference, Oct., 1984, pp. 43–53.

Gordon, *Backplane Interconnection System,* Presented at International Electronic Packaging Society Symposium, San Diego, Calif., (Nov. 1986).

Simpson et al., *Connector with High Contact Density and Controlled Impedance.*

Lockard, "System Approach to High-Speed Digital Packaging", Reprinted from *Electronics Packaging and Production* (Sep., 1986).

"A New Generation in Interconnection Technology", Augaut/Microtech, dated 9/84.

*Primary Examiner*—J. Patrick McQuade

[57] ABSTRACT

An electrical connector system for electrically interconnecting electrically conductive paths of a first circuit with corresponding electrically conductive paths of a second circuit. The system includes backer structure with guide structure that is adapted to receive a first circuit which has a first array of pad-type contacts, and a cooperating connector assembly component that includes contact carrier structure with camming structure and that is adapted to receive a second circuit which has a second array of pad-type contacts corresponding to the pad-type contacts of the first array, and actuator structure that includes camming structure for interaction with camming structure of the contact carrier structure. Elastomeric foam structure interconnects the actuator and said contact carrier structures in a manner enabling the camming structures to engage. First guide structure associated with the actuator structure allows restrained movement of the actuator structure towards the backer structure, and second guide structure cooperating between the contact carrier structure and the backer structure allows translational movement of the contact carrier structure while maintaining the pad-type conatcts of the first and second circuits in alignment as the actuator structure causes the camming structures to concurrently compress the elastomeric coupling member and produce lateral movement of the contact carrier structure parallel to the plane of the pad-type conatacts in wiping action as guided by the engaged guide structures.

20 Claims, 3 Drawing Sheets

U.S. PATENT DOCUMENTS

| | | | |
|---|---|---|---|
| 3,873,173 | 3/1975 | Anhalt | 339/17 CF |
| 3,999,826 | 12/1976 | Yurtin | 339/17 F |
| 4,092,057 | 5/1978 | Walton | 339/17 F |
| 4,116,517 | 9/1978 | Selvin | 339/17 F |
| 4,164,003 | 8/1979 | Cutchaw | 339/17 CF |
| 4,169,642 | 10/1979 | Mouissie | 339/17 F |
| 4,330,163 | 5/1982 | Aikens et al. | 339/17 F |
| 4,392,700 | 7/1983 | Showman | 339/17 M |
| 4,420,203 | 12/1983 | Aug et al. | 339/17 CF |
| 4,511,197 | 4/1985 | Grabbe et al. | 339/17 CF |
| 4,540,227 | 9/1985 | Faraci | 439/77 |
| 4,552,420 | 11/1985 | Eigenbrode | 339/14 R |
| 4,553,192 | 11/1985 | Babuka et al. | 339/17 M |
| 4,602,317 | 7/1986 | Rovnyak et al. | 339/17 F |
| 4,626,056 | 12/1986 | Andrews, Jr. et al. | 439/260 |
| 4,629,270 | 12/1986 | Andrews, Jr. et al. | 439/260 |
| 4,636,019 | 1/1987 | Gillett et al. | 439/493 |
| 4,647,125 | 3/1987 | Landi et al. | 439/67 |
| 4,655,524 | 4/1987 | Etzel | 339/59 M |
| 4,690,472 | 9/1987 | Elco et al. | 439/67 |
| 4,695,258 | 9/1987 | Hanson et al. | 439/67 |

FIG. 1
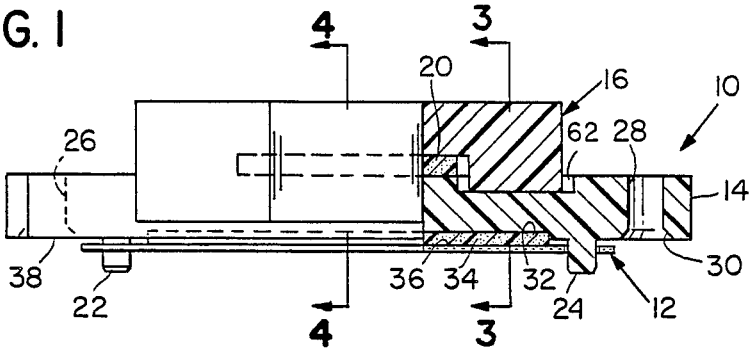
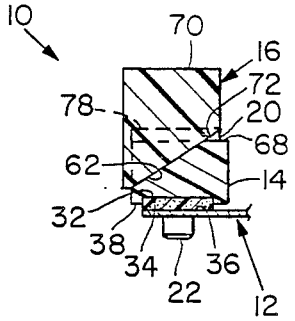
FIG. 3
FIG. 2
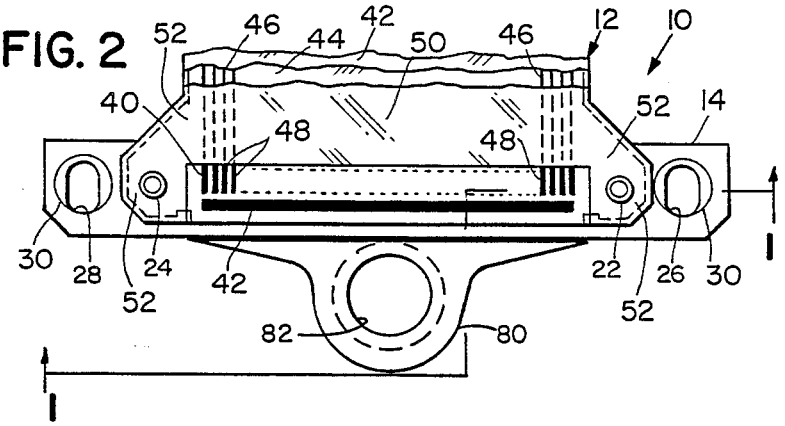
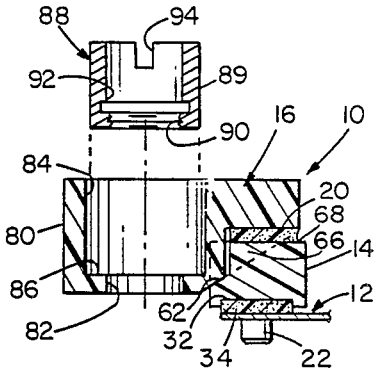
FIG. 4
FIG. 5
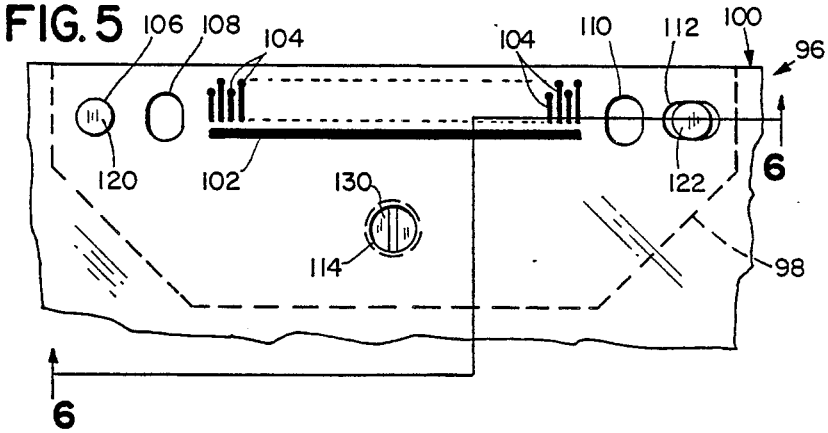
FIG. 6
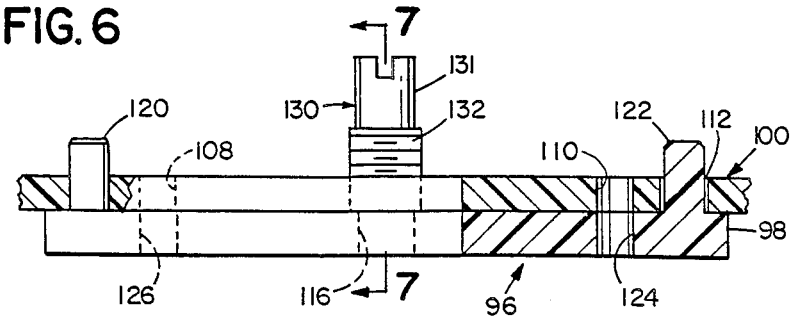
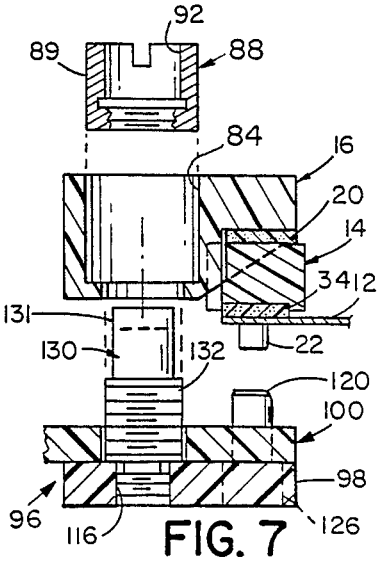
FIG. 7

CONNECTOR ARRANGEMENT

This invention relates to electrical circuit interconnections, and more particularly to connector arrangements of the type that are particularly useful with electronic circuit components of the semiconductor type.

Integrated circuitry developments require circuit interconnection configurations of greater density, as well as circuit path configurations that control impedance and resistive effects which may alter circuit performance. Conventionally employed methods of interconnecting electrical or electronic circuit components have included the "pin and socket" type and the so-called "zero force insertion" type in which a circuit card may be inserted when cooperating contacts are in an open position, and the contacts are then cammed to a closed position. These and other techniques have required substantial space or generally have a tendency to utilize complex arrangements and complicated manufacturing procedures. Additionally, certain types of commercially employed connectors cannot be easily matched in impedance to the circuit cards being connected, thus causing reflections which degrade signal quality. Such problems are particularly acute when connectors are used with newer generation semiconductors which have high switching speeds (100–500 picosecond rise time), low switching energy and signal swings in the microvolts range, the resulting disadvantages including poor signal quality caused by high crosstalk, rise time degradation, and reflections due to impedance mismatch. An improved but somewhat complex electrical connector system is disclosed in copending application Ser. No. 864,786, filed May 19, 1987, now abandoned, and entitled ELECTRICAL CIRCUIT INTERCONNECTION In accordance with one aspect of the invention, there is provided an electrical connector system for electrically interconnecting electrically conductive paths of a first circuit with corresponding electrically conductive paths of a second circuit. The system includes backer structure with guide structure that is adapted to receive a first circuit which has a first array of pad-type contacts, and a cooperating connector assembly component that includes contact carrier structure that includes camming structure and is adapted to receive a second circuit which has a second array of pad-type contacts corresponding to the pad-type contacts of the first array, actuator structure that includes camming structure for interaction with camming structure of the contact carrier structure, and elastomeric coupling structure interconnecting the actuator and said contact carrier structures in a manner enabling the camming structures to engage. First guide structure associated with the actuator structure allows restrained movement of the actuator structure towards the backer structure, and second guide structure cooperating between the contact carrier structure and the backer structure allows translational movement of the contact carrier structure while maintaining the pad-type contacts of the first and second circuits in alignment as the actuator structure causes the camming structures to concurrently compress the elastomeric coupling member and produce lateral movement of the contact carrier structure parallel to the plane of the pad-type contacts in wiping action as guided by the engaged guide structures.

In preferred embodiments, the system further includes resilient contact array mounting structure in the form of a resilient sheet member having low stress relaxation when in compression that is carried by the contact carrier structure. Both the resilient elastomeric coupling structure and the resilient contact array mounting structure may be of open or closed cell foam-type material, such material preferably having a density in the range of 2–50 pounds per cubic inch, and an air or cell volume in the range of about 25–95 percent, the foam-type material having a compression set, tested by ASTM Test Standard D3574 of less than ten percent compression set after 22 hours at 158° F. at 50 percent compression with one half hour recovery. Such foam material is preferably selected from the group consisting of urethanes, silicones, natural rubbers, copolymers of butadiene-styrene, butadiene-acrylonitrile, butadiene-isobutylene, chloroprene polymers, polysulfide polymers, plasticized vinyl chloride, and acetate polymers and copolymers, and is in sheet form and has a thickness of less than one half centimeter. The camming structures are planar surfaces disposed at an acute angle to the second planar array of pad-type contacts. The resilient elastomeric coupling and contact array mounting structures cooperate to produce increasing contact (downward) force during wiping as well as the ultimate contact force when the system is in its final position; and the elastomeric coupling member returns the system to its initial position upon release of clamping force.

In particular embodiments, the foam mounting and coupling structures are disposed parallel to one another, the mounting structure being disposed between the second array of the pad-type contacts and the contact carrier structure and the coupling structure being bonded to and interconnecting the contact carrier and actuator structures so that the camming surfaces are in juxtaposed position for camming engagement. Centrally located clamping structure that includes a threaded post member and a cooperating sleeve member moves the actuator structure towards the backer structure and produces lateral movement of the contact carrier structure in the wiping action while restraining lateral movement of the actuator structure relative to the backer structure. In those embodiments, the second circuit is of transmission line type and includes a plurality of conductor traces with terminal pads at one end spaced less than one hundred mils on center, and at least one ground plane, the conductor traces having the same characteristic impedance and being impedance matched to circuits being interconnected by the second circuit.

Other features and advantages of the invention will be seen as the following description of a particular embodiment progresses, in conjuction with the drawings, in which:

FIG. 1 is a side view (with parts broken away as indicated by line 1—1 of FIG. 2) of a connector assembly component of an electrical connector system in accordance with the invention;

FIG. 2 is a bottom view of the connector assembly component of FIG. 1;

Figure 9:
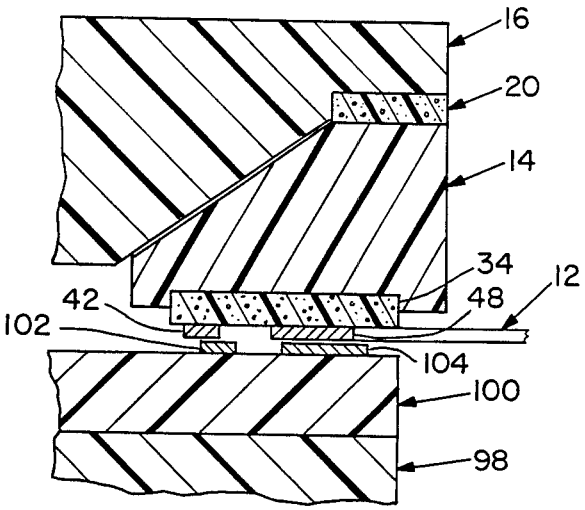
Figure 10:
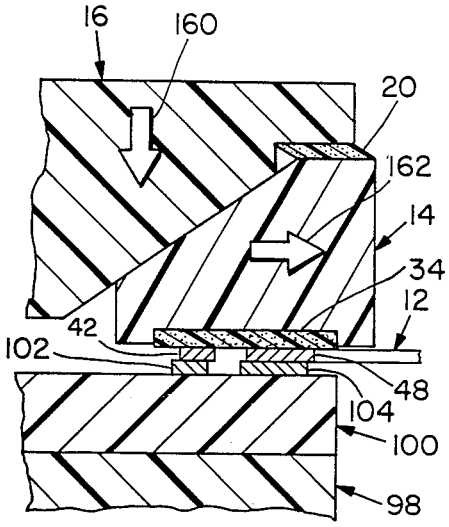
Figure 8:
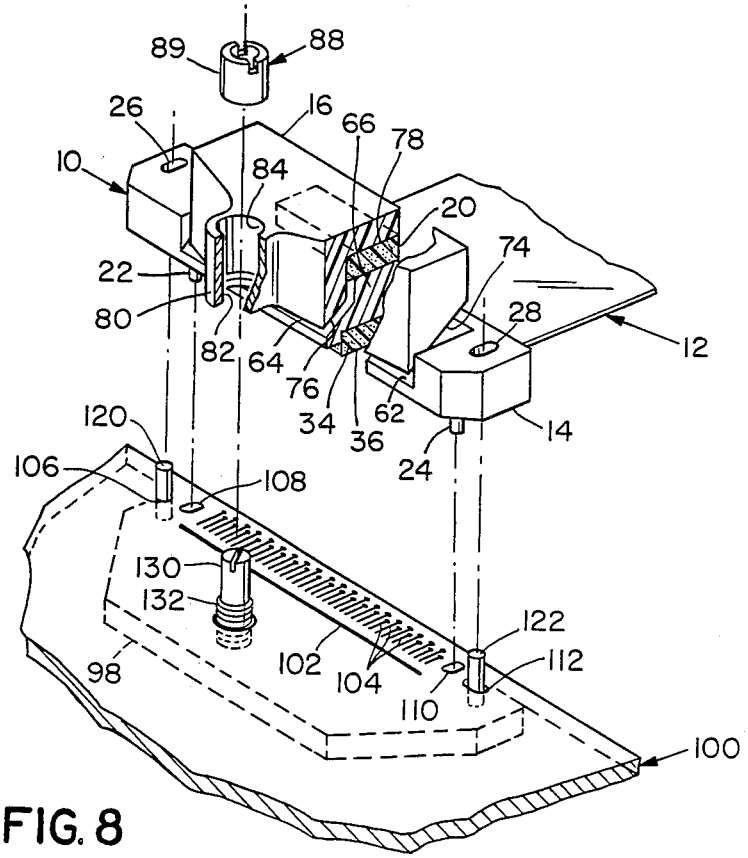
Figure 11:
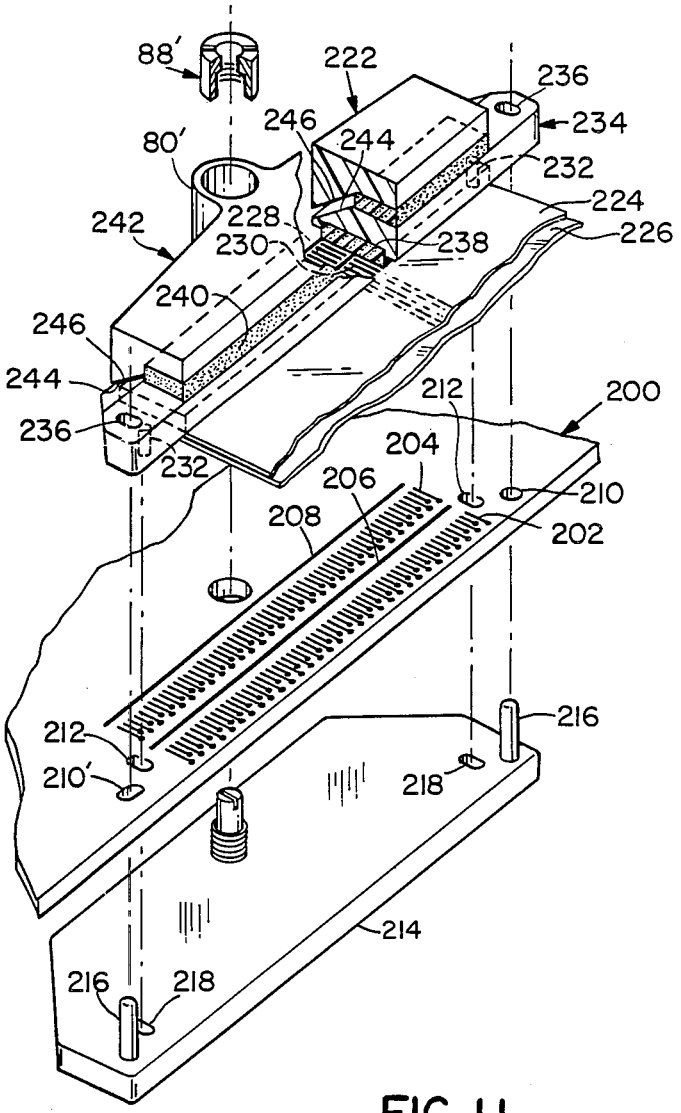

FIGS. 3 and 4 are sectional views taken along the lines 3—3 and 4—4, respectively of FIG. 1;

FIG. 5 is a plan view of a printed circuit board and connector component for cooperation with the connector assembly component of FIG. 1;

FIG. 6 is a side elevational view (with parts broken away as indicated by line 6—6 of FIG. 5) of the printed circuit board and connector component of FIG. 5;

FIG. 7 is a sectional view taken along the line 7—7 of FIG. 6;

FIG. 8 is a perspective view (with parts broken away) of the electrical connector system shown in FIGS. 1–7;

FIGS. 9 and 10 are sectional diagrammatic views illustrating the wiping and electrical interconnection actions of the connector assembly components of FIGS. 1 and 5; and FIG. 11 is a perspective view of portions of a second electrical connector system in accordance with the invention.

DESCRIPTION OF PARTICULAR EMBODIMENTS

Shown in FIGS. 1–4 and 8 are views of a connector assembly component 10 that is adapted to carry a flexible transmission line circuit 12 of "microstrip" configuration. The assembly component 10 includes circuit carrier member 14 of thermoset, polymeric resin on which flex circuit 12 is disposed and actuator member 16 also of thermoset, polymeric resin that is secured to circuit connector member 14 by resilient coupling member 20 of polymeric foam material. Circuit carrier member has depending alignment posts 22, 24 and guide slots 26, 28.

Contact carrier member 14, in this embodiment, has a length of about six centimeters, a width of about one centimeter, and a height of about 0.6 centimeter. Each depending post 22, 24 has a length of about three millimeters and a diameter of about 2.4 millimeters. The center-to-center spacing of posts 22, 24 is about four centimeters. Slot 26 has a width of about three millimeters and a length of about four millimeters while slot 28 has a width of about 3.3 millimeters and a length of about four millimeters, each slot having tapered entrance surfaces as indicated at 30. Formed in the lower surface of contact carrier 14 is recess 32 that has a depth of about one millimeter, a width of about six millimeters and a length of about three and one half centimeters. Disposed in recess 32 is a resilient foam pad 34 of polymeric material that has a thickness of about two millimeters so that its surface 36 projects about one millimeter beyond surface 38 of circuit carrier member 14.

Disposed on posts 22, 24 and foam pad 34 is terminal pad portion 40 of flexible transmission line circuit 12. Circuit 12 is of "microstrip" configuration and includes one ounce copper ground plane that terminates in exposed ground terminal strip 42. Overlying ground plane is dielectric 44 (three mil thick glass reinforced fluorocarbon (Rogers RO-20500)) that has a low dielectric constant (2.5) and a low loss factor, and disposed on dielectric 44 are a set of one ounce copper conductor traces 46, (each six mils in width) that extend to terminal pads 48 (one hundred mils long and ten mils wide on twenty-five mil center-to-center spacing); and one mil thick cover film 50. The flexible circuits provide controlled impedance high density transmission line conductors (traces 46) from terminal pads 48 to corresponding terminals at the opposite ends of traces 46. At either side of the contact pad array 40 is a fastener portion 52 that includes an aperture into which posts 22, 24, respectively, are inserted.

As indicated in FIGS. 1, 3, 4 and 8, carrier member 14 has two spaced inclined main ramp surfaces 62 that are connected by bridging ramp strip 64. Adjacent ramp strip 64 and between ramp structures 62 is raised portion 66 that includes planar surface 68 that is parallel to surface 38. Each ramp surface 62, 64 is inclined at an angle of about 34° to surface 68, each main ramp surface 62 having a width of about 0.8 centimeter and a ramp length of about 0.8 centimeters.

Actuator member 16 includes body portion 70 in which two main ramp surfaces 74 and ramp connector strip 76 are formed. Planar recess surface 78 is between main ramp surfaces 74. Body 70 has a length of about three and one half centimeters and the two parallel ramp surfaces 74 are each inclined at an angle of about 34° to the intermediate recess surface 78 of actuator block 16. Surface 78 has a length of about two centimeters and a width of about 0.6 centimeters. Adhesively secured on surface 78 is resilient silicone foam strip 20 that has a thickness of about two millimeters, a length of about two centimeters and a width of about 0.6 centimeter. The opposite surface of strip 20 is adhesively secured to surface 68 of contact carrier member 14 so that strip 20 interconnects contact member 14 and actuator block 16 with ramp surfaces 62 in juxtaposition for engagement with ramp surfaces 74 of actuator block 16.

Resilient foam members 20, 34 may be of high density flexible polymeric foam which possesses resistance to compression set of the type described in U.S. Pat. No. 4,468,074. Each sheet 20, 34 has an uncompressed thickness of about two millimeters and is elastomeric foam material having a density of about 20 pounds per cubic foot with an air or cell volume in the range of about 65 percent. The elastomeric members 20, 34 have a compression set, as tested by ASTM Test Standard D3574, of less than ten percent compression set after 22 hours at 158° F. at 50 percent compression with a one half hour recovery. The foam material of coupling member 20 is preferably a silicone foam.

Actuator block 16 has a centrally located boss 80 in which is formed cylindrical opening 82 and concentric cylindrical bore 84, concentric bore 84 having a diameter of about one centimeter and opening 82 having a diameter of about 0.7 centimeter between which concentric surfaces are formed seat surface 86.

Actuator nut 88 (FIG. 4) has a cylindrical outer surface 89 received and guided in bore 84 of actuator block 16, and cylindrical inner surface 92 that receives and is guided on unthreaded upper surface 131 of stud 130. The lower section 90 of cylindrical nut is threaded and is adapted to engage threads 132 of stud 130 (FIG. 6). Slots 94 in the fastener 88 cooperate with a spanner for threading action.

The cooperating connector component 96 shown in FIGS. 5–8 includes backup plate 98 which may be molded of an appropriate electrically insulating polymeric material and receives printed circuit board 100 that carries ground terminal 102 and connector pads 104 that may be connected to circuits on board 100 by through hole connections. Also formed in circuit board 100 is cylindrical aperture 106; elongated apertures 108, 110, 112; and cylindrical aperture 114 that is aligned with threaded bore 116 in backup plate 98 in which stud 130 is secured. Upstanding from plate 98 are posts 120, 122, each of which has a diameter of about three millimeters and a height of about four millimeters; and formed in backup plate 98 are elongated slots 124, 126 of shape that correspond to the elongated apertures 108, 110 in circuit board 100, the slots 124, 126 and apertures 108, 110 each having a length dimension of about six millimeters and a width dimension of about three millimeters. Threadedly secured in bore 116 is stud 130 which has a second intermediate threaded portion 132.

As indicated above, the contact pad array of flex circuit 12 is accurately positioned relative to the connector assembly 10 by posts 22 and 24. Similarly, the circuit board 100 is accurately positioned on backup plate 98 by posts 120, 122. When connector assemblies 10 and 96 are in aligned position, post 22 is disposable in elongated slot 126, post 24 is disposable in elongated slot 124, post 120 is disposed in elongated slot 26, and post 122 is disposed in elongated slot 28, that interengagement accurately laterally positioning the connector assemblies and the contact pad arrays they carry. The differences in width dimensions between post 22 and aperture 126, post 24 and aperture 124, and post 122 and aperture 28 accommodate manufacturing tolerances while maintaining accurate contact pad array positioning.

The connector assembly 10 with the flex circuit 12 is positioned as indicated in FIGS. 7 and 8 over printed circuit board 100 and its backer plate 98 and lowered so that the connector arrays contact pads are disposed as indicated in the diagram in FIG. 9, contact pads 42 and 48 being inwardly offset from the corresponding contact pads 102 and 104 of the printed circuit board 100. As actuator nut 88 is tightened on stud 130, it moves actuator member 16 downwardly (arrow 160), and its ramp surfaces 74 slide along ramp surfaces 62 of contact carrier member 14. The cooperation of the cylindrical surfaces of nut 88 and bore 84 prevents lateral movement of actuator member 16 so that the contact carrier member 14 slides in the outward direction (arrow 162) stressing the elastomeric foam coupling member 20 in compression and shear while the resilient contact support elastomeric foam member 34 is also compressed as indicated in FIG. 9 producing pressure and wiping action between the surfaces of contact pad members 42 and 102 and 48 and 104. The resulting combined actions and applied pressure (clamping pressures of 40 to 50 psi at 50 percent compression of foam member 34) produce low contact resistance circuit interconnections.

In a second embodiment (shown in FIG. 11), the connector system is utilized with a circuit board 200 that includes two rows of pad-type contact terminals 202, 204 together with associated ground terminals 206, 208 that are connected by plated through holes to circuits carried by the printed board 200. In a particular embodiment, contact pads 202, 204 have dimensions of about 0.2 millimeter by 2.5 millimeter and are disposed on 0.6 millimeter centers. Board 200 also includes positioning apertures 210, 210', and guide apertures 212. Backup member 214 has posts 216 that receive apertures 210, 210' for location and slots 218 that are aligned with apertures 212 similar to the embodiment shown in FIGS. 1–8. The cooperating connector assembly 222 carries flexible circuits 224, 226 that have contact pad arrays 228, 230 corresponding to the terminal arrays 202, 204, 206, 208 of the printed circuit board 200 and that are received on posts 232 of carrier member 234. Carrier member 234 also has apertures 236 which receives upstanding posts 216.

Similar to the embodiment shown in FIGS. 2–8, an elastomeric foam pad 238 supports contact arrays 228, 230 and elastomeric coupling pad 240 that extends the length of carrier member 234 provides resilient attachment of carrier member 234 to actuator member 242. Carrier member 234 and actuator member 242 have ramp surfaces 244, 246 that are in engagement. Movement of actuator member 242, which has a component of downward motion in the vertical direction but is restrained against lateral or transverse movement, towards the printed circuit board 200 produces interacting concurrent compression and translational forces on coupling member 240 which are transmitted to the carrier member 234 and the flexible circuit contacts 228, 230 carried by it so that durable low contact resistance circuit interconnections are provided between the flexible circuits 224, 226 and the printed circuit board 200.

While particular embodiments of the invention have been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. An electrical connector system for electrically interconnecting electrically conductive paths of a first circuit with corresponding electrically conductive paths of a second circuit comprising backer structure adapted to receive a first circuit which has a first array of pad-type contacts, said backer structure including guide structure, a cooperating connector assembly component that includes contact carrier structure adapted to receive a second circuit which has a second array of pad-type contacts corresponding to the pad-type contacts of said first array and includes camming structure, actuator structure that includes camming structure for interaction with camming structure of said contact carrier structure, elastomeric coupling structure interconnecting said actuator structure and said contact carrier structure in a manner enabling said camming structures to engage, first guide structure associated with said actuator structure for allowing restrained movement of said actuator structure towards said backer structure, second guide structure cooperating between said contact carrier structure and said backer structure allowing translational movement of said contact carrier structure while maintaining the pad-type contacts of said first and second circuits in alignment as said actuator structure causes said camming structures to concurrently compress said elastomeric coupling member and produce lateral movement of said contact carrier structure parallel to the plane of said pad-type contacts in wiping action as guided by the engaged guide structures.

2. The connector system of claim 1 and further including resilient contact array mounting structure carried by said contact carrier structure, said resilient contact array mounting structure including a resilient sheet member having low stress relaxation when in compression.

3. The connector system of claim 2 wherein each of said elastomeric coupling structure and said resilient contact array mounting structure is of open cell or closed cell foam-type material that has a density in the range of 2–50 pounds per cubic inch, and an air or cell volume in the range of about 25–95 percent, said foam-type material having a compression set, tested by ASTM Test Standard D3574 of less than ten percent compression set after 22 hours at 158° F. at 50 percent compression with one half hour recovery.

4. The connector system of claim 3 wherein said foam material of said mounting and coupling structures is selected from the group consisting of urethanes, silicones, natural rubbers, copolymers of butadiene-styrene, butadiene-acrylonitrile, butadiene-isobutylene, chloroprene polymers, polysulfide polymers, plasticized vinyl chloride, and acetate polymers and copolymers.

5. The connector system of claim 3 wherein said foam material mounting and coupling structures are in sheet form and each has a thickness of less than one half centimeter.

6. The connector system of claim 5 wherein said foam mounting and coupling structures are disposed parallel to one another, said mounting structure being disposed between said second array of the pad-type contacts and said contact carrier structure, said coupling structure being bonded to and interconnecting said contact carrier structure and said actuator structure so that said camming structures are in juxtaposed position for camming engagement.

7. The connector system of claim 1 and further including centrally located clamping structure for moving said actuator structure towards said backer structure during lateral movement of said contact carrier structure in said wiping action while lateral movement of said actuator structure relative to said backer structure is restrained.

8. The connector system of claim 7 wherein said centrally located clamping structure includes a post member and a sleeve member that is threadedly received on said post member.

9. The connector system of claim 1 wherein said second circuit is of transmission line type and includes a plurality of conductor traces with terminal pads at one end spaced less than one hundred mils on center, and at least one ground plane, said conductor traces having the same characteristic impedance and being impedance matched to circuits being interconnected by said second circuit.

10. The connector structure of claim 1 wherein said camming structures are planar surfaces disposed at an acute angle to said second array of pad-type contacts.

11. The connector system of claim 1 wherein said elastomeric coupling structure is of foam-type material that has a density in the range of 2–50 pounds per cubic inch, and an air or cell volume in the range of about 25–95 percent, said foam-type material having a compression set, tested by ASTM Test Standard D3574 of less than ten percent compression set after 22 hours at 158° F. at 50 percent compression with one half hour recovery.

12. The connector system of claim 11 wherein said foam material of said mounting and coupling structures is selected from the group consisting of urethanes, silicones, natural rubbers, copolymers of butadiene-styrene, butadiene-acrylonitrile, butadiene-isobutylene, chloroprene polymers, polysulfide polymers, plasticized vinyl chloride, and acetate polymers and copolymers.

13. The connector system of claim 11 wherein said foam material coupling structure is in sheet form and has a thickness of less than one half centimeter.

14. The connector system of claim 13 wherein said second circuit is of transmission line type and includes a plurality of conductor traces with terminal pads at one end spaced less than one hundred mils on center, and at least one ground plane, said conductor traces having the same characteristic impedance and being impedance matched to circuits being interconnected by said second circuit.

15. The connector structure of claim 14 wherein said camming structures are planar surfaces disposed at an acute angle to said second array of pad-type contacts.

16. The connector system of claim 15 and further including resilient contact array mounting structure carried by said contact carrier structure, said resilient contact array mounting structure including a resilient sheet member having low stress relaxation when in compression.

17. The connector system of claim 16 wherein said mounting and coupling structures are in sheet form and each has a thickness of less than one half centimeter.

18. The connector system of claim 17 wherein said mounting and coupling structures are disposed parallel to one another, said mounting structure being disposed between said second array of the pad-type contacts and said contact carrier structure, said coupling structure being bonded to and interconnecting said contact carrier structure and said actuator structure so that said camming surfaces are in juxtaposed position for camming engagement.

19. The connector system of claim 18 and further including centrally located clamping structure that includes a post member and sleeve structure that is axially received on said post member for preventing lateral movement of said actuator structure relative to said backer structure while said actuator structure is moved towards said backer structure to produce lateral movement of said contact carrier structure in said wiping action.

20. The connector system of claim 19 wherein said post member and said sleeve structure have threaded portions for cooperative interengagement.

* * * * *

UNITED STATES PATENT AND TRADEMARK OFFICE

CERTIFICATE OF CORRECTION

PATENT NO. : 4,768,971

DATED : September 6, 1988

INVENTOR(S) : Scott S. Simpson

It is certified that error appears in the above-identified patent and that said Letters Patent is hereby corrected as shown below:

In the ABSTRACT, line 7 from the bottom, "conatcts" should be --contacts--;

In the ABSTRACT, line 2 from the bottom, "conatacts" should be --contacts--;

Col. 7, claim 6, line 17, "structures" should be --structure--.

Signed and Sealed this

Twentieth Day of June, 1989

*Attest:*

DONALD J. QUIGG

*Attesting Officer*

*Commissioner of Patents and Trademarks*